US006682036B1

(12) United States Patent
Hsu

(10) Patent No.: US 6,682,036 B1
(45) Date of Patent: Jan. 27, 2004

(54) CEILING FIXTURE

(75) Inventor: Kevin Hsu, Taichung (TW)

(73) Assignee: Dong Guan Bright Yin Huey Lighting Co., Ltd., Guang Dong (CN)

( * ) Notice: Subject to any disclaimer, the term of this patent is extended or adjusted under 35 U.S.C. 154(b) by 0 days.

(21) Appl. No.: 10/374,972

(22) Filed: Feb. 28, 2003

(51) Int. Cl.[7] ..... B42F 13/00; F21S 8/06

(52) U.S. Cl. ..... 248/343; 248/342; 362/404; 362/363

(58) Field of Search ..... 248/343, 342, 248/344, 345; 362/404, 409, 363, 147

(56) References Cited

U.S. PATENT DOCUMENTS 980,308 A * 1/1911 Lumley ..... 248/344
1,841,727 A * 1/1932 Glowacki ..... 248/343
2,861,121 A * 11/1958 Wolar ..... 174/61
2,867,404 A * 1/1959 Ramsing ..... 248/324
4,342,073 A * 7/1982 Ranten ..... 362/294
5,034,869 A * 7/1991 Choi ..... 362/363
5,085,393 A * 2/1992 Ryan ..... 248/343
5,491,618 A * 2/1996 Vakil ..... 362/147
5,568,969 A * 10/1996 Yu ..... 362/404
5,797,721 A * 8/1998 Yu ..... 362/147
5,826,975 A * 10/1998 Hsieh et al. ..... 362/414

* cited by examiner

*Primary Examiner*—Anita King
(74) *Attorney, Agent, or Firm*—Rosenberg, Klein & Lee

(57) ABSTRACT

An improved ceiling feature and particularly a ceiling feature that can be installed easily to anchor a holding dish. It mainly includes a ceiling plate fastened to the ceiling for engaging with a bolt. The holding dish may be coupled with the bolt in the direction of the ceiling. By depressing a stem end of a fastening mechanism, the elastic plate set may be moved to move the latch notches formed thereon so that the latch notches may wedge in the screw pitches of the bolt to anchor the holding dish without dropping. Then a glass shade and a cap may be coupled and a nut may be fastened to hold the ceiling feature securely.

3 Claims, 8 Drawing Sheets

CEILING FIXTURE

BACKGROUND OF THE INVENTION

1. Field of the Invention

The invention relates to an improved ceiling fixture and particularly a ceiling fixture that has elastic plates to latch on the screw pitches to anchor a holding dish to facilitate installation of a ceiling lamp.

2. Description of the Prior Art

Conventional ceiling fixtures now available on the market are generally constructed as the one shown in FIGS. 1, 2 and 3. It mainly includes a ceiling plate 2 fastening to a preformed cavity 11 on the ceiling 1 through screws 21. A holding dish 31 is fastened to the ceiling plate 2 for coupling with a ceiling lamp 3 through fastening screws 22. The holding dish 31 has fastening holes 311 to receive the fastening screws 22, and the holding dish 31 is turned for anchoring on the screws. Then a bolt 32 is provided with one end screwing in a screw hole 312 formed on the holding dish 31 and another end coupling with a glass shade 33 and a cap 34. Finally a nut 35 is provided to couple with the bolt 32 to complete the assembly of the ceiling lamp 3. Such a construction has the following disadvantages:

1. Before installation, the fastening screws 22 must be fastened to the ceiling plate 2. Next, the holding dish 31 is coupled from the lower side to the upper side, and the fastening holes 311 of the holding dish 31 are coupled with the fastening screws 22. The holding dish 31 is turned for positioning at a desired location. Then the fastening screws 22 are tightened. Although the actions mentioned above can fasten the holding dish 31 to the ceiling plate 2, they involve many cumbersome operations. Moreover, the ceiling plate 2 usually is installed on the ceiling which is high above the floor, people have to climb and work on an elevated location, and have to turn and tighten the fastening screws 22 while holding the holding dish 31 with one hand. It is an inefficient operation.

2. When the holding dish 31 is fastened to the ceiling plate 2, and the bolt 32 is fastened to the screw hole 312 of the holding dish 31, the glass shade 33 and the cap 34 have to be fastened by the nut 35. As the glass shade 33 is quite heavy and is supported merely by the bolt 32 fastening to the holding dish 31 which in turn is fastened to the ceiling plate 2 through the fastening screws 22, to bear such a heavy load by means of such a support structure is quite risky in the long run.

SUMMARY OF THE INVENTION

In view of the aforesaid disadvantages, the primary object of the invention is to provide an improved ceiling fixture that has a stronger support to bear the heavy weight of the ceiling lamp and is easier to install.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
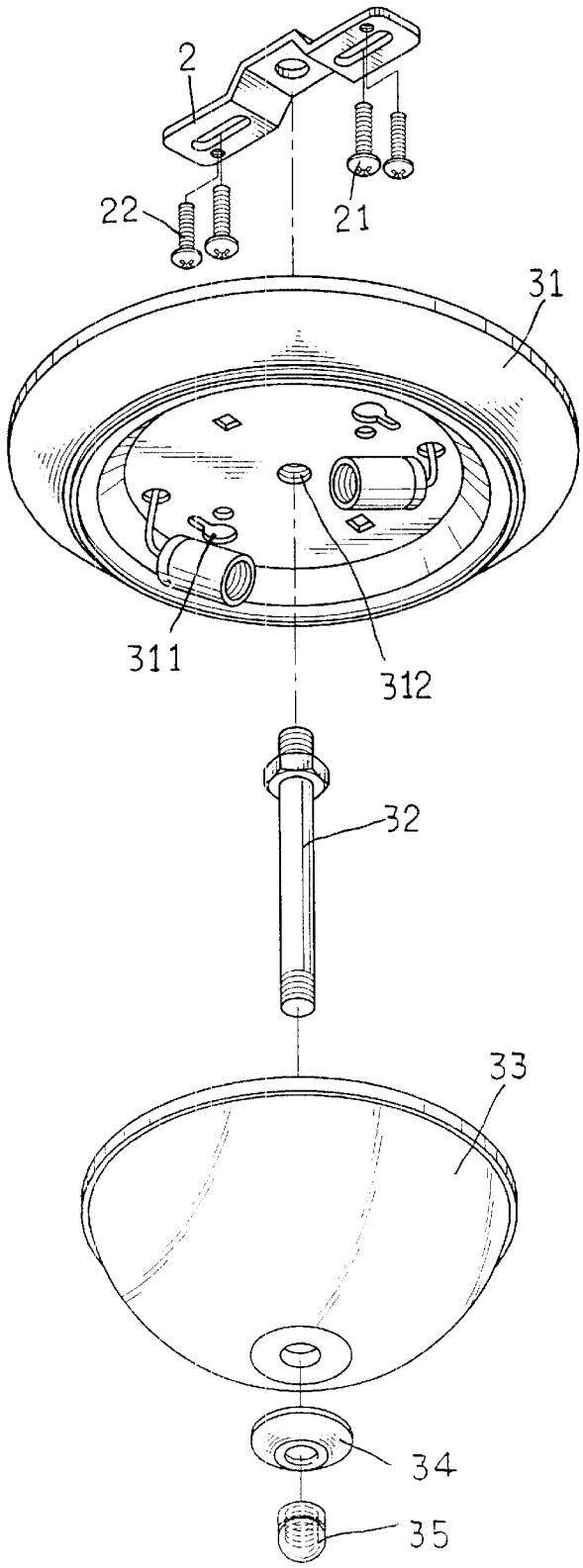
FIG. 1 PRIOR ART
FIG. 1 is an exploded view of a conventional ceiling fixture.
Figure 2:
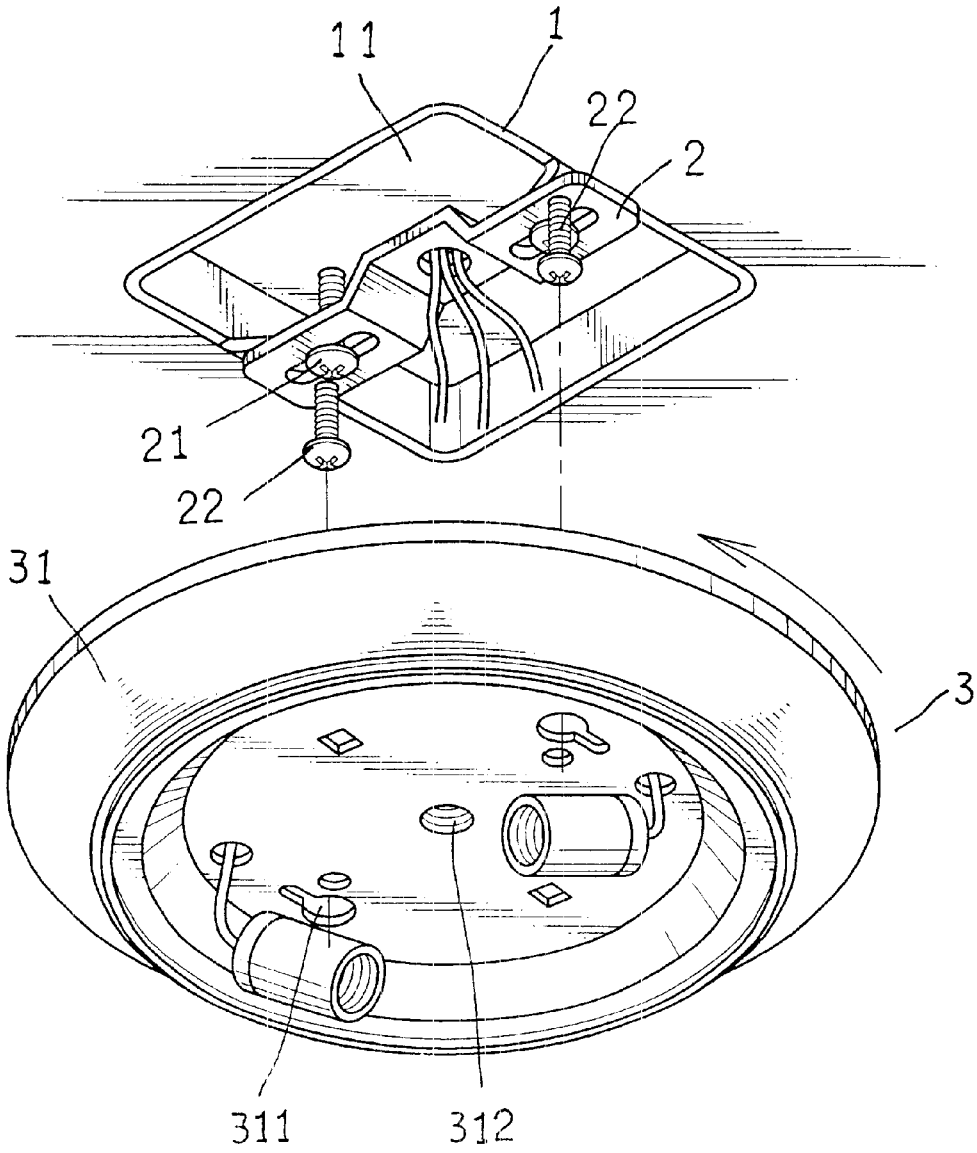
FIG. 2 PRIOR ART
FIG. 2 is a schematic view of a:conventional ceiling plate and a holding dish.
Figure 3:
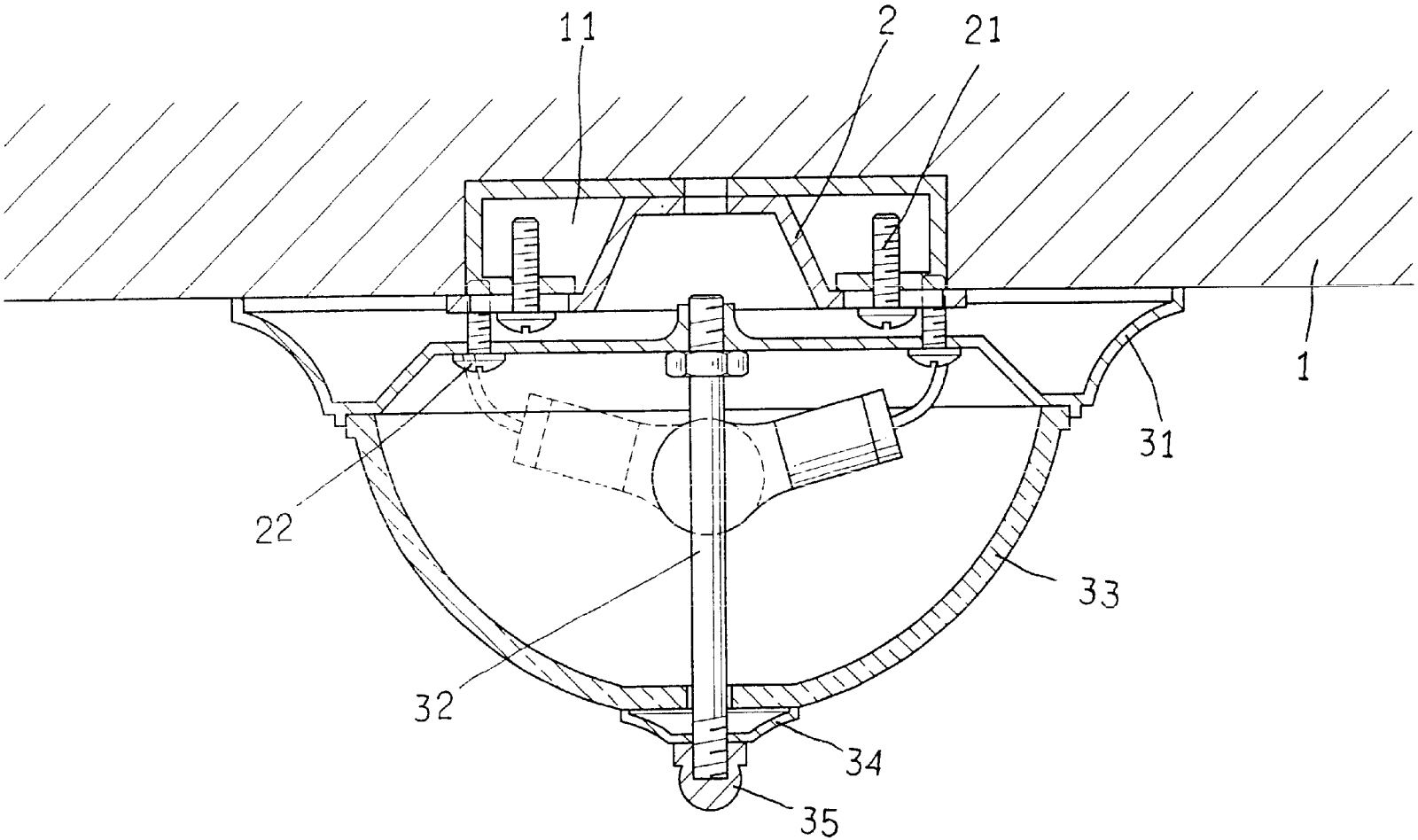
FIG. 3 PRIOR ART
FIG. 3 is a sectional view of a conventional ceiling fixture.
Figure 4:
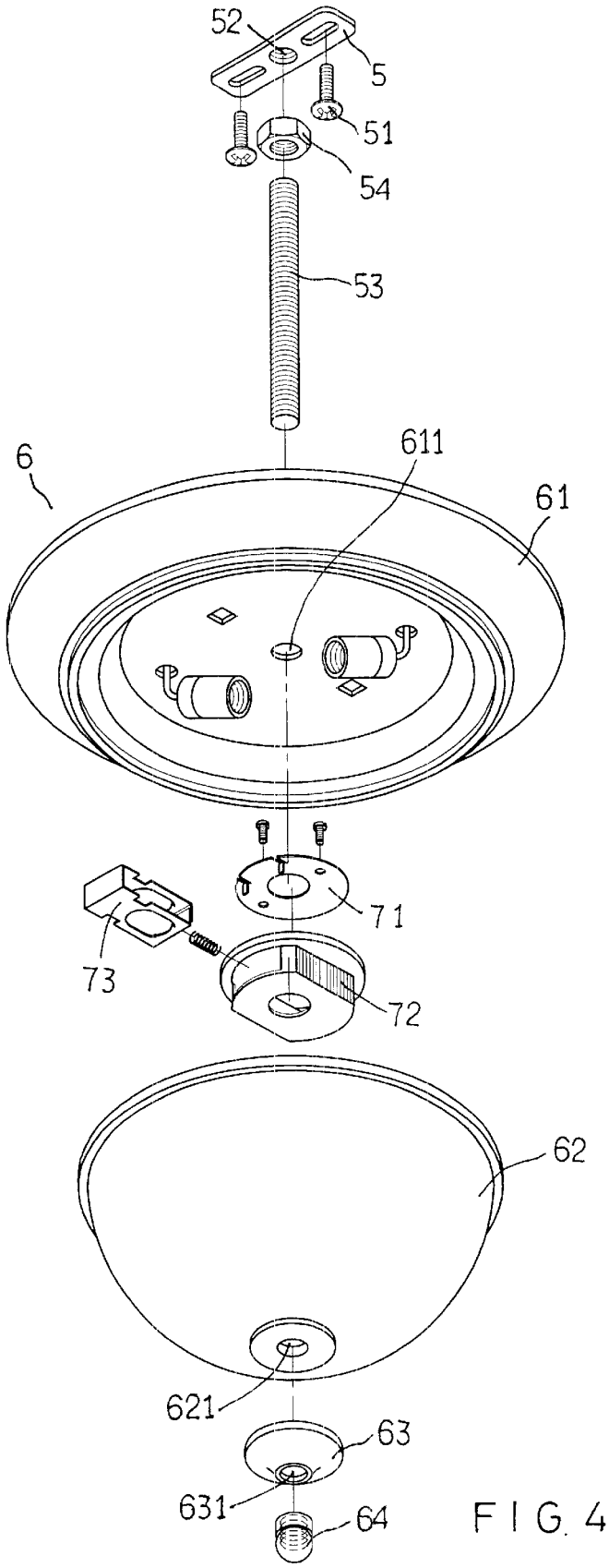
FIG. 4 is an exploded view of the invention.
Figure 5:
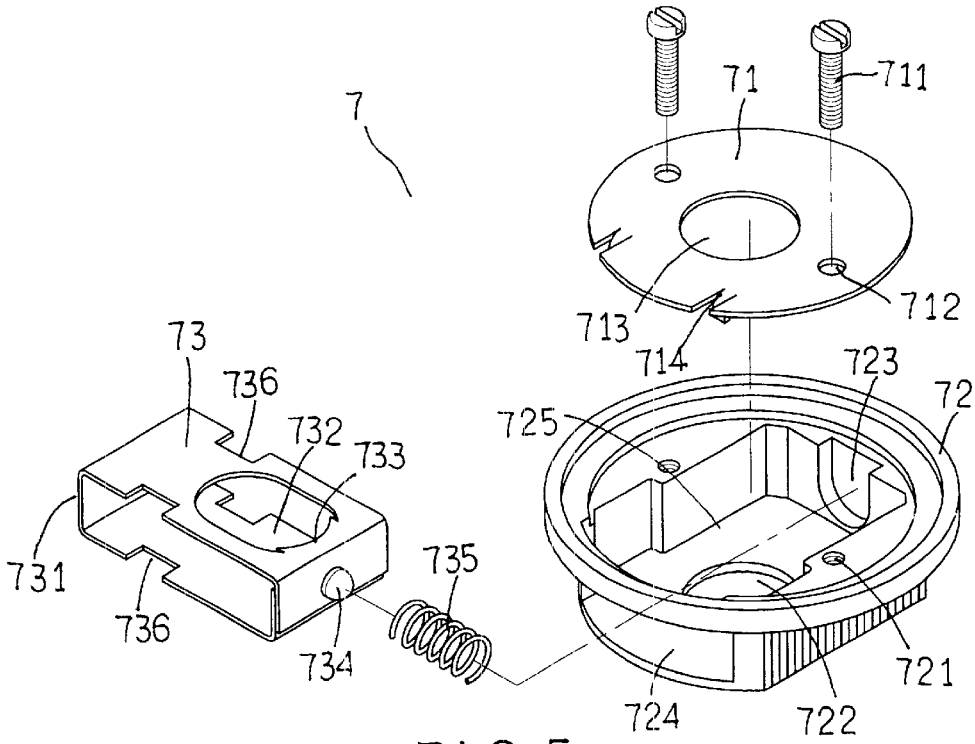
FIG. 5 is an exploded view of the fastening means of the invention.
Figure 6:
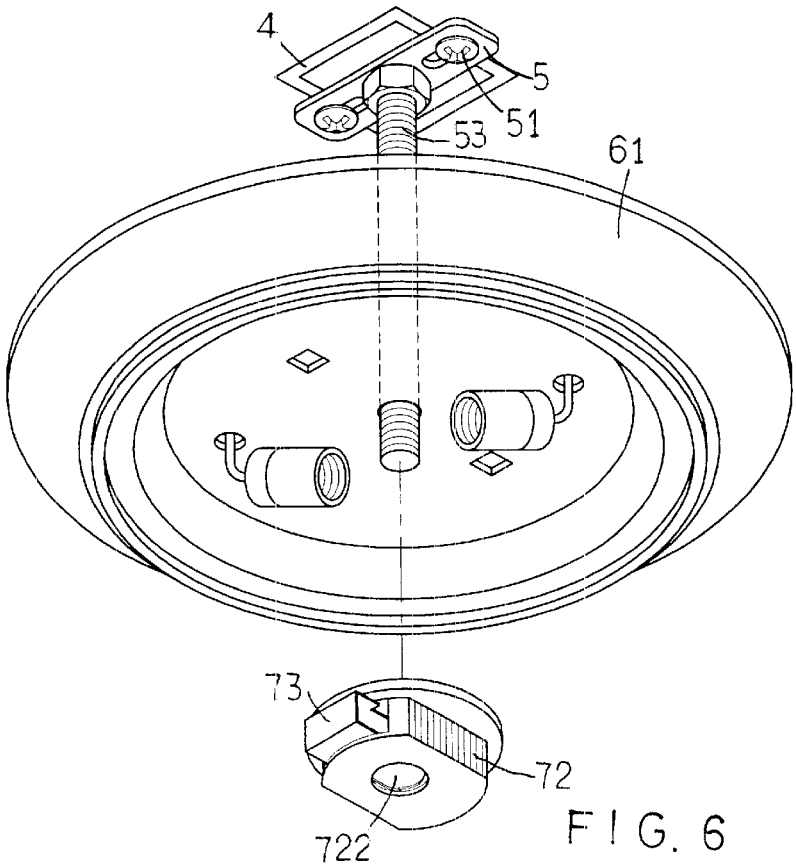
FIG. 6 is a schematic view of the ceiling plate and the holding dish of the invention.

Referring to FIGS. 4, 5 and 6, the invention mainly includes a ceiling plate 5 fastened to the ceiling 4 through screws 51. The ceiling plate 5 has a screw hole 52 to engage with a bolt 53. The bolt 53 is coupled with a fastening nut 54 for fastening the bolt 53 in the screw hole 52.

There is a ceiling lamp 6 which includes a holding dish 61, a glass shade 62, a cap 63 and a nut 64. The holding dish 61 has an opening 611 to enable the bolt 53 to run through. The glass shade 62 and the cap 63 have respectively an aperture 621 and 631 to allow the bolt 53 to run through. The bolt 53 is engaged with the nut 64 to hold the glass shade 62 and the cap 63.

A fastening means 7 is provided between the holding dish 61 and the glass shade 62. The fastening means 7 includes an upper lid 71 which has apertures 712 and a switch box 72 which has a notch 724 on one side and screw holes 721 to engage with screws 711 which also pass through the apertures 712 of the upper lid 71. The upper lid 71 and the switch box 72 are coupled to form a housing chamber 725, and have respectively an opening 713 and 722 corresponding to each other. The housing chamber 725 holds an elastic plate set 73. The elastic plate set 73 has a stem end 731 extending outside the housing chamber 725 and a through trough 732. The elastic plate set 73 has one end apart the stem end 731 forming latch notches 733 on the inner side of the through trough 732. The elastic plate set 73 has a distal end forming a stub 734 to hold a spring 735 which has another end held in a recess 723 formed on the inner side of the switch box 72. The elastic plate set 73 has two sides forming respectively a notch 736 corresponding to each other. The notch 736 is coupled with a latch hook 714 formed on each of the two sides of the upper lid 71 for retaining the elastic plate set 73.

Figure 7:
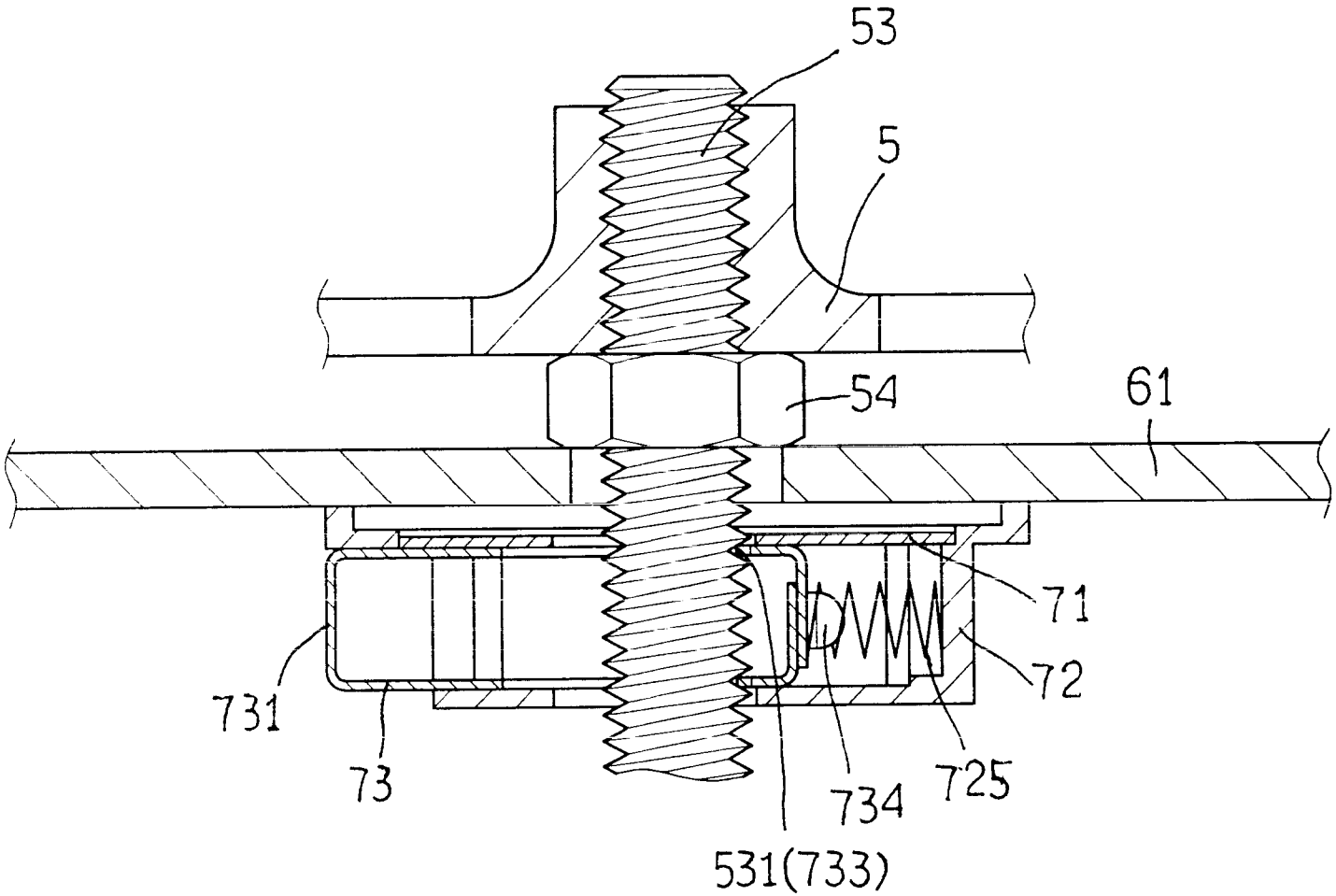
FIG. 7 is a fragmentary sectional view of the fastening means coupling with a bolt according to the invention.
Figure 8:
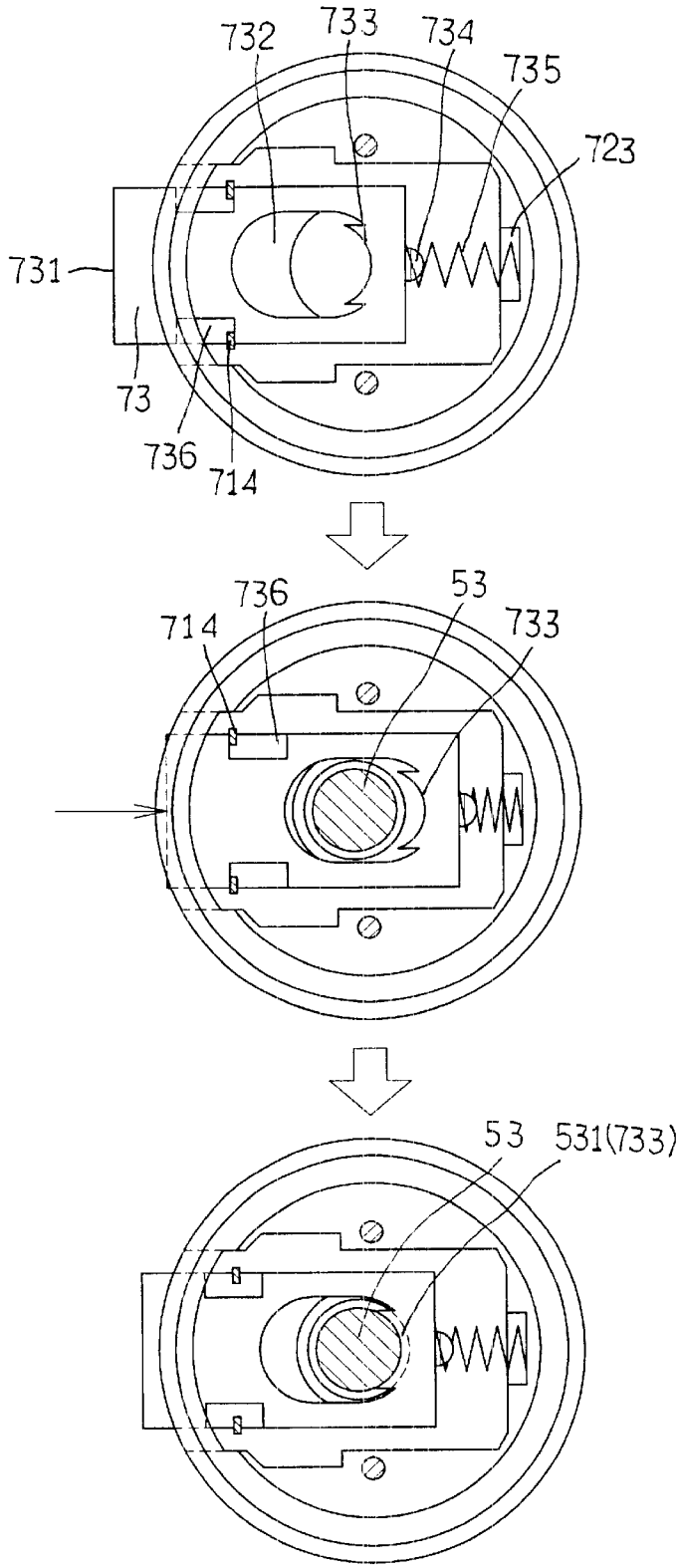
FIG. 8 is a schematic view of the elastic plate of the invention in an operating condition.
Figure 9:
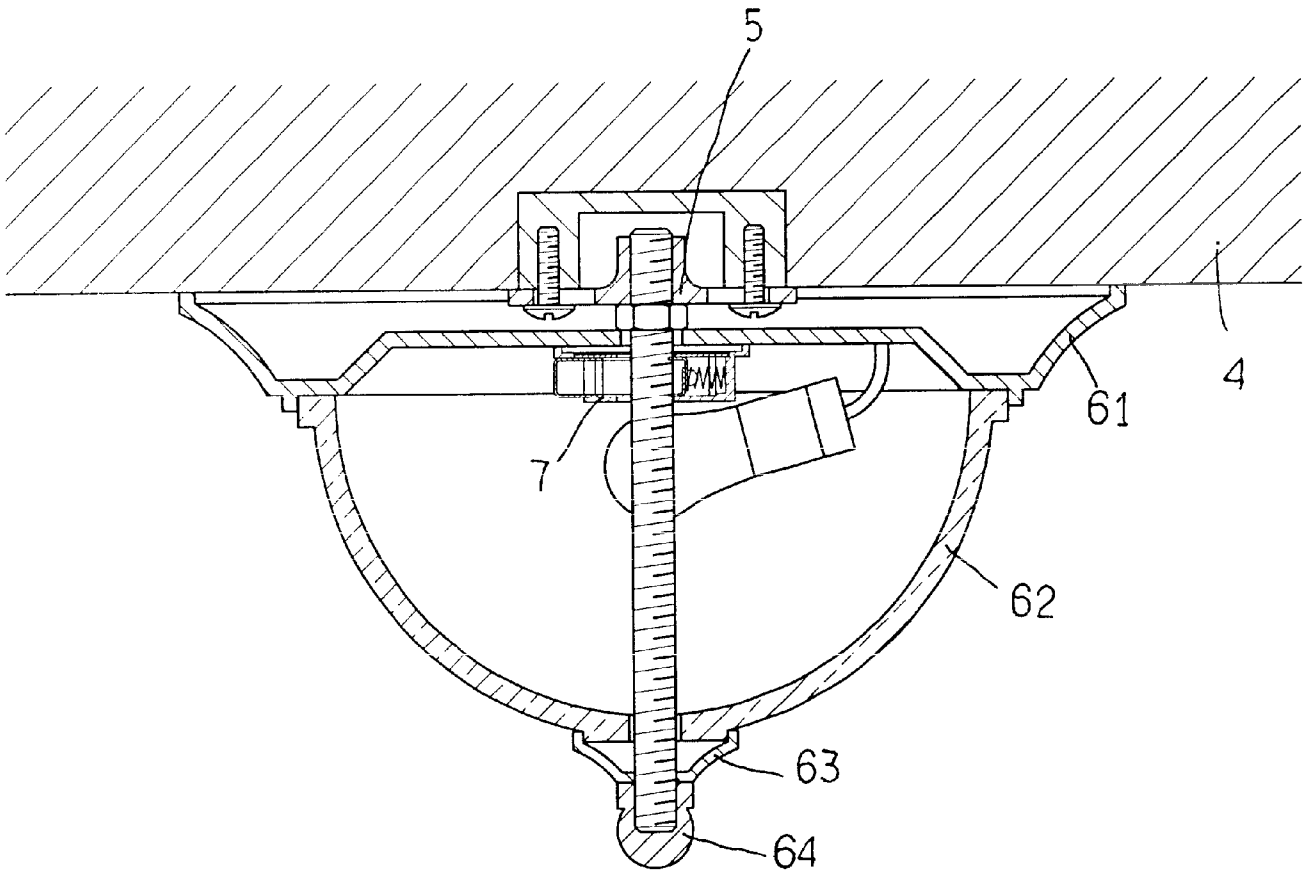
FIG. 9 is a sectional view of the invention after assembled.

Referring to FIGS. 7, 8 and 9, for assembling and installing the ceiling lamp 6, first, engage the bolt 53 with the screw hole 52 of the ceiling plate 5 and fasten the fastening nut 54 tightly to anchor the bolt. Next, fasten the ceiling plate 5 to the ceiling 4, then couple the holding dish 61 on the bolt 53. In the mean time, dispose the elastic plate set 73 in the housing chamber 725 and fasten the screws 711 to retain the switch box 72 in the housing chamber 725. Depress the stem end 731 of the elastic plate set 73 to move the latch notches 733. Then couple the fastening means 7 on the bolt 53 to allow the bolt 53 to pass through the opening 713 of the upper lid 71 and the opening 722 of the switch box 72. Once the fastening means 7 reaches a desired position, release the stem end 731. The elastic force of the spring 735 pushes the elastic plate set 73 to its original position (as shown in FIG. 8). Then the latch notches 733 wedge in the screw pitches 531 of the bolt 53. Thus the holding dish 61 may be anchored without dropping.

Meanwhile, the notches 736 are retained by the latch hooks 714 of the upper lid 71 so that the elastic plate set 73 is prohibited from ejecting out of the housing chamber 725. Then the glass shade 62 and the cap 63 may be coupled on the bolt 53 in this order, and the nut 64 may be coupled with the bolt for fastening.

By means of the aforesaid construction, users may fasten the ceiling plate 5 which has already coupled with the bolt 53 to the ceiling 4. Then the holding dish 61 may be coupled on the bolt 53. Meanwhile depress the stem end 731 of the elastic plate set 73 to move the latch notches 733 outwards so that the bolt 53 may smoothly run through the fastening means 7. When the fastening means 7 reaches the desired location, release the stem end 731, the holding dish 61 may be anchored securely. Then the glass shade 62 and the cap 63 may be coupled and fastened to complete the installation.

In summary, the invention provides a simple assembly and installation method through the elastic plate set. Installation of the ceiling lamp is much easier. Even general consumers can do it without difficulty. And the risky tasks of climbing to a high place to fasten the screws are no longer necessary.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. An improved ceiling fixture, comprising:

a ceiling plate fastened to a ceiling through screws having a screw hole to engage with a bolt, the bolt being engaged with a fastening nut for fastening the bolt in the screw hole;

a ceiling lamp including a holding dish, a glass shade, a cap and a nut; and a fastening means located between the holding dish and the glass shade including an upper lid and a switch box which has a notch on one side, the upper lid and the switch box having respectively an opening corresponding to each other and being coupled together to form a housing chamber for holding an elastic plate set, the elastic plate set having a stem end extending outside the housing chamber, a through trough formed thereon and another end apart the stem end extending into the housing chamber to form latch notches on an inner side of the through trough, the elastic plate set further having a stub formed on a distal end to hold a spring, the spring having another end held in a recess formed on an inner side of the switch box, the elastic plate set further having two corresponding notches formed on two sides thereof to couple with two latch hooks formed on two sides of the upper lid for retaining the elastic plate set.

2. The improved ceiling fixture of claim 1, wherein the latch notches wedge in a screw pitch of the bolt after the elastic plate set was released.

3. The improved ceiling fixture of claim 1, wherein the upper lid has apertures to allow second screws to pass through to engage with screw holes formed on the switch box.

* * * * *